United States Patent [19]

Oberley

[11] Patent Number: 4,843,745

[45] Date of Patent: Jul. 4, 1989

[54] PRESS AND METHOD OF MAKING SAME

[75] Inventor: Gene L. Oberley, Cincinnati, Ohio

[73] Assignee: American Laundry Machinery, Inc., Cincinnati, Ohio

[21] Appl. No.: 267,349

[22] Filed: Nov. 4, 1988

Related U.S. Application Data

[63] Continuation of Ser. No. 42,149, Apr. 24, 1987.

[51] Int. Cl.[4] ..... D06F 71/08

[52] U.S. Cl. ..... 38/34; 38/35; 38/40

[58] Field of Search ..... 38/34, 35, 40

[56] References Cited

U.S. PATENT DOCUMENTS

| | | | |
|---|---|---|---|
| 1,886,644 | 11/1982 | Clarke . | |
| 1,903,402 | 4/1933 | Locke | 38/34 |
| 1,984,496 | 12/1934 | Rapisarda | 68/9 |
| 2,307,686 | 1/1943 | Keopke | 38/40 |
| 2,326,015 | 8/1943 | Davis | 38/40 |
| 2,382,224 | 8/1945 | Hicks | 38/40 |
| 2,443,573 | 6/1948 | Brundage | 38/35 X |
| 2,599,238 | 6/1952 | Dayton | 38/35 |
| 2,728,152 | 12/1955 | Campbell | 38/35 |
| 3,490,159 | 1/1970 | Radford et al. | 38/35 |
| 3,496,660 | 2/1970 | Frisby | 38/35 |
| 3,500,567 | 3/1970 | Tucker et al. | 38/35 |
| 4,459,770 | 7/1984 | Brent | 38/34 |

FOREIGN PATENT DOCUMENTS

| | | |
|---|---|---|
| 315784 | 11/1929 | United Kingdom . |
| 380370 | 9/1932 | United Kingdom . |

*Primary Examiner*—Ronald Feldbaum
*Attorney, Agent, or Firm*—Bacon & Thomas

[57] ABSTRACT

A press and in particular a garment press and method of making same are provided wherein such press has a support structure, a first member carried by the support structure and is adapted to support a workpiece, a second member carried by the support structure, an actuator for urging the second member toward the first member and against the workpiece to apply a pressing force thereagainst, and guide means operatively connected between the second member and the support structure for guiding the second member toward and away from the first member with the actuator and guide means cooperating to enable the actuator to apply the pressing force while keeping the support structure free of loads caused by the actuator.

29 Claims, 5 Drawing Sheets

PRESS AND METHOD OF MAKING SAME

This application is a continuation of application Ser. No. 042,149, filed Apr. 24, 1987.

BACKGROUND OF THE INVENTION

1. Field of the Invention

This inventions relates to a press and method of making same and more particularly to a garment press such as a so-called dry cleaning press, or a laundry press.

2. Prior Art Statement

Presses of various types, including garment presses, are well known in the art and have been in use for many years.

Some of the known garment presses are of the type which utilize a plurality of power actuating means or actuators for operation thereof and examples of such presses are disclosed in U.S. Pat. Nos. 2,728,152 and 3,490,159.

Others of the known garment presses are of the type which basically utilize a single actuating means or actuator and examples of such presses are illustrated in U.S. Pat. Nos. 1,984,496 and 3,496,660.

It is also known in the art of garment presses that it is advantageous to provide a pressing head in which the construction and arrangement of components are such that the pressing head does not radiate heat toward an operator standing in front thereof thereby causing early operator fatigue. An example of such a press which is also of the known type wherein a plurality of actuating means are utilized is illustrated in the above-mentioned U.S. Pat. No. 2,728,152.

It is also known to provide a pressing or force application technique in which a supporting structure basically carriers only the weight of a pressing means yet such pressing means is capable of exerting substantial forces to provide its pressing function. A simple form of such an arrangement is a simple vise resting on supporting structure in the form of a workbench.

However, regardless of whether a garment press utilizes a plurality of actuating means or a single actuating means, there are two basic types of garment presses which are used more commonly than others. These two types are referred to as the scissors press in which the movement of the pressing head could be likened to a scissors movement and a fastback press in which the movement of the pressing head is a fastback movement in which, as the term suggests, the pressing head is moved rapidly away from a stationary buck with which it associates so as to move such head rapidly away from a press operator and minimize operator fatigue.

The garment presses in common use including the types and specific constructions disclosed above have certain deficiencies including deficiencies of being complex, comparatively expensive to manufacture and maintain, and require comparatively heavy and massive support structures.

SUMMARY OF THE INVENTION

Accordingly, it is a feature of this invention to provide a press and method of making same which overcomes the above-mentioned deficiencies. In overcoming such deficiencies the press of this invention utilizes the basic concept of a simple vise supported on a workbench, utilizes a single actuating means which employs cooperating components which require only a minimum light weight support structure, and provides a construction in which the pressing head does not radiate heat toward an operator yet provides all of the advantages of a fastback press.

Another feature of this invention is to provide a new press having a support structure, a first member carried by the support structure and being adapted to support a workpiece, a second member carried by the support structure, and actuating means for urging the second member toward the first member and against the workpiece to apply a pressing force thereagainst.

In accordance with one embodiment of this invention the new press comprises guide means operatively connected between the second member and the support structure for guiding the second member toward and away from the first member and the actuating means and guide means cooperate to enable the actuating means to apply the pressing force while keeping the support structure free of loads caused by the actuating means.

Another feature of this invention is to provide a new garment press having a support structure, a buck carried by the support structure and being adapted to support a garment to be pressed, a head assembly carried by the support structure, and actuating means for urging the head assembly toward the buck and against the garment to apply a pressing force thereagainst.

In accordance with another embodiment of this invention, the guide means of the above-mentioned garment press is operatively connected between the head assembly and the support structure for guiding the head assembly toward and away from the buck and wherein the actuating means and guide means cooperate to enable the actuating means to apply the pressing force, while keeping the support structure free of loads caused by the actuating means.

Accordingly, it is an object of this invention to provide a new press of this invention having one or more of the novel features as set forth above or hereinafter shown or described.

Another object of this invention is to provide a new garment press of this invention having one or more of the novel features as set forth above or hereinafter shown or described.

Another object of this invention is to provide a new method of making a press having one or more of the novel features as set forth above or hereinafter shown or described.

Other features, objects, uses, and advantages of this invention are apparent from a reading of this description which proceeds with reference to the accompanying drawings forming a part thereof.

BRIEF DESCRIPTION OF THE DRAWINGS

The accompanying drawings show present preferred embodiments of this invention, in which.

DESCRIPTION OF PREFERRED EMBODIMENTS

Figure 1:
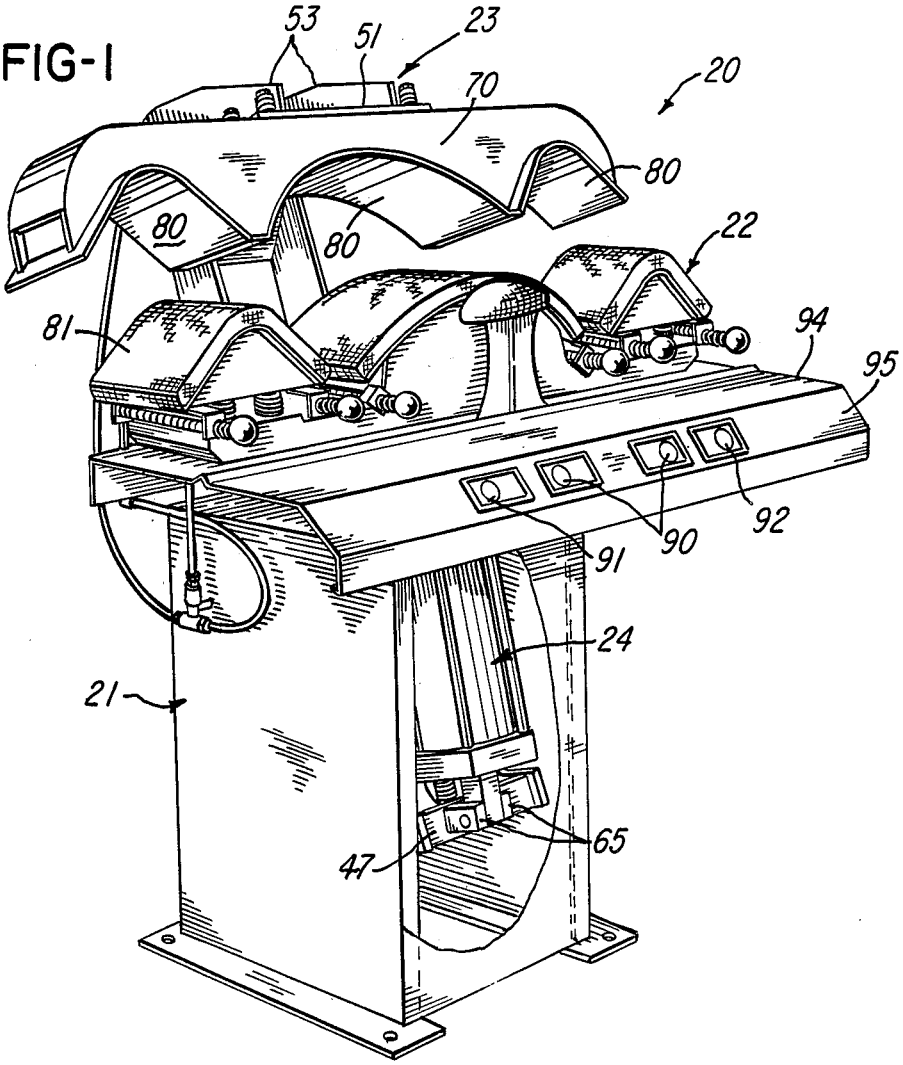
FIG. 1 is an isometric view with parts broken away illustrating one exemplary embodiment of a press of this invention in the form of a garment press particularly adapted for pressing garments in the form of shirts; and particularly illustrating a support structure, a first member in the form of a buck carried by the support structure, a second member in the form of a head assembly carried by the support structure, and actuating means in the form of an air cylinder for urging the head assembly toward the buck and against the workpiece or shirt carried thereon.

While the various features of this invention are hereinafter illustrated and described as being particularly adapted to provide a press in the form of the garment press and method of making same, it is to be understood that the various features of this invention can be utilized singly or in various combinations using techniques known in the art to provide or make other presses capable of being used to operate on or press workpieces other than garments.

Therefore, this invention is not to be limited to only the embodiments illustrated in the drawings, because the drawings are merely utilized to illustrate certain ones of the wide variety of uses of this invention.

Reference is now made to FIG. 1 of the drawings which illustrates one exemplary embodiment of a press of this invention which is in the form of a garment press; and, in this particular example, a shirt press which is designated generally by the reference numeral 20. The press 20 has a supporting frame assembly or a support structure which is designated generally by the reference numeral 21. The press 20 also has a first member in the form of a buck 22 carried by the support structure and such buck is adapted to support a workpiece which in this example of a garment press for pressing shirts would be in the form of a shirt (not shown).

The press 20 has a second member in the form of a head assembly 23 carried by the support structure; and, such press has actuating means designated generally by the reference numeral 24 for urging the head assembly 23 toward the first member or buck 22 and against the workpiece or shirt carried by the buck 22 to apply a pressing force thereagainst.

Figure 6:
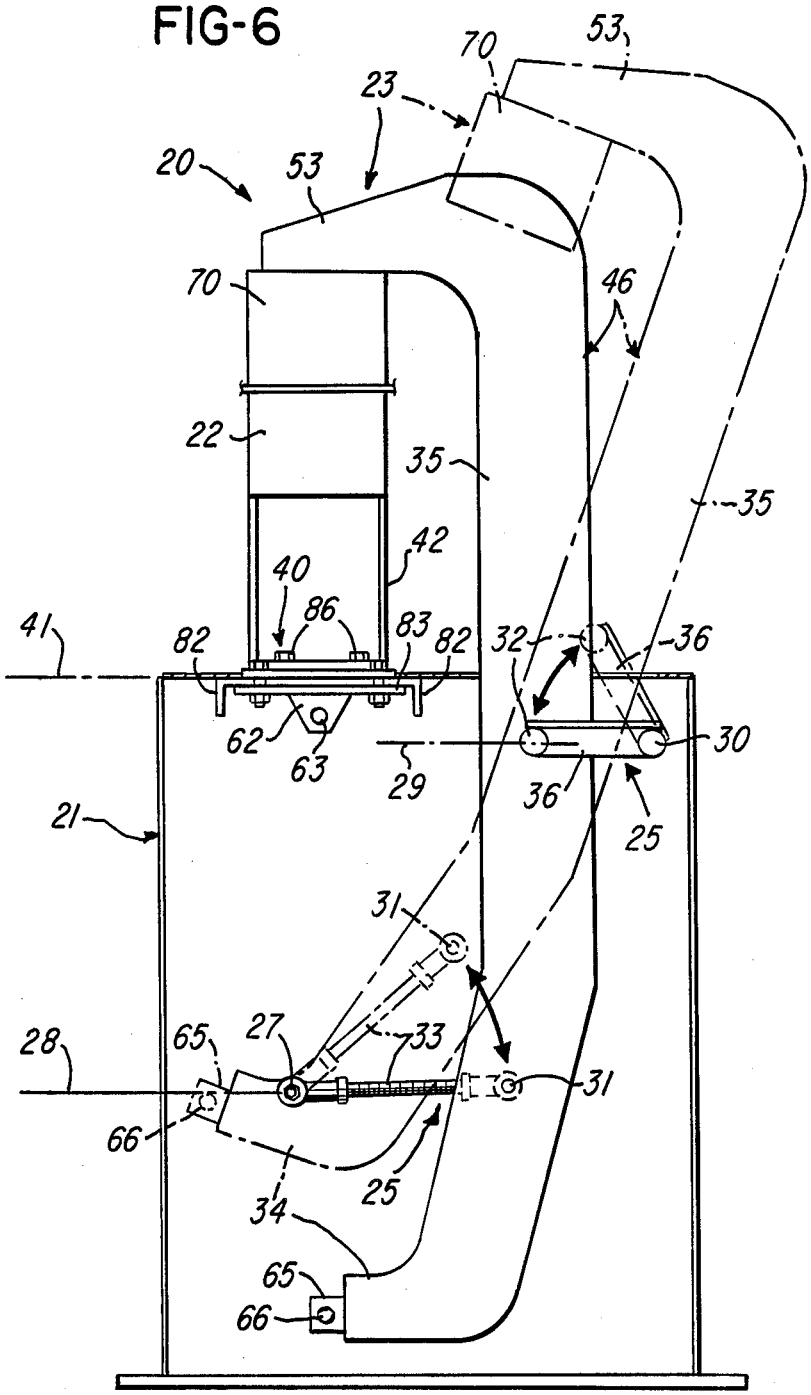
FIG. 6 is a view particularly illustrating the head assembly in its pressing position by solid lines and in its retracted position by dotted lines and illustrating the action of guide means associated therewith.

The press has guide means designated generally by the reference numeral 25 at two locations 25 in FIG. 6. The guide means 25 is operatively connected between the head assembly 23 and the support structure 21 for guiding the head assembly 23 toward and away from the buck 22.

Figure 3:
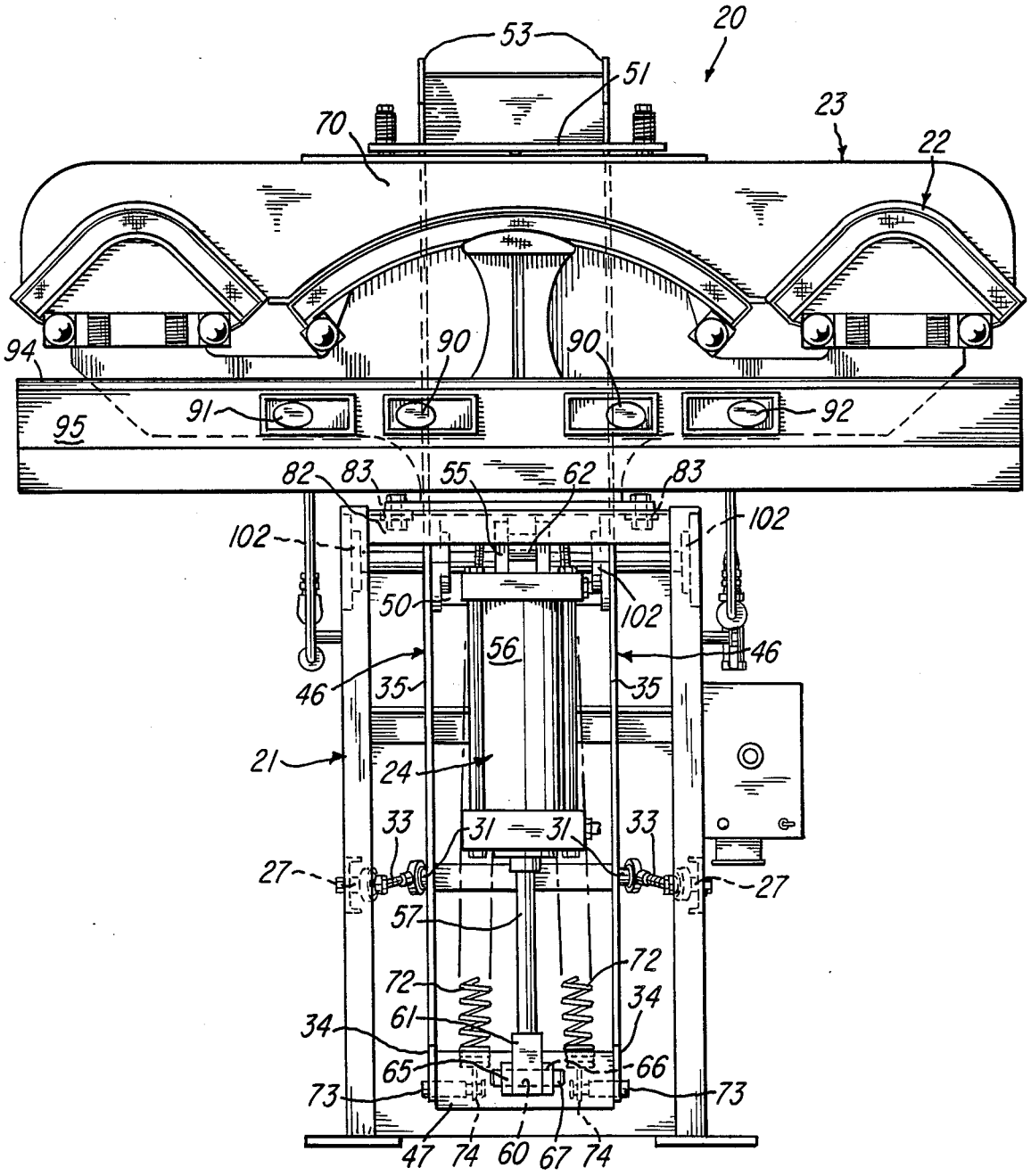
FIG. 3 is a front view of the press illustrated in FIG. 1 with the front panel of the support structure removed.
Figure 4:
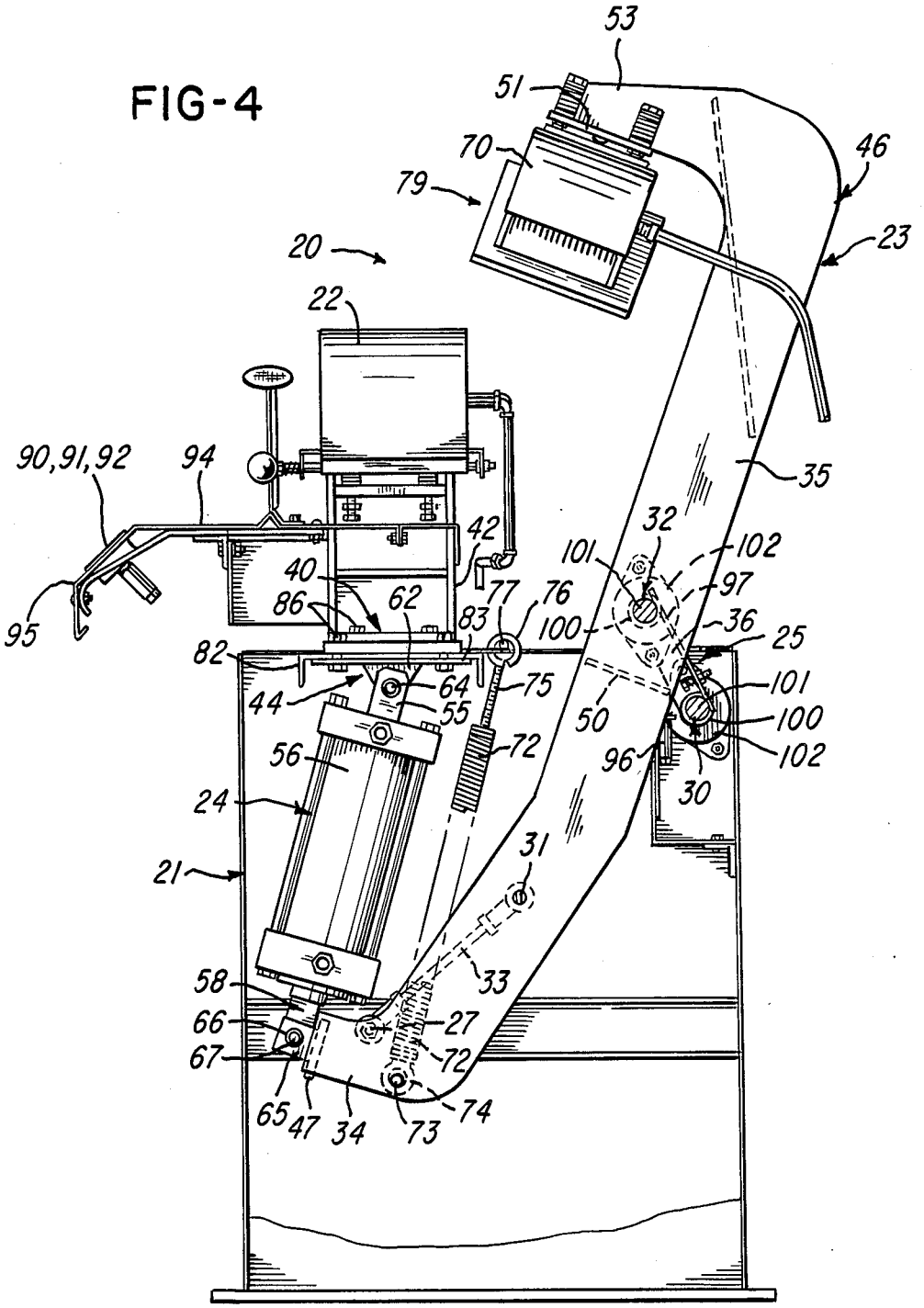
FIG. 4 is a view of such press with parts in elevation, parts in cross-section, and parts broken away particularly illustrating the head assembly in its retracted position.

In accordance with the teaching of this invention the actuating means 24 and guide means 25 cooperate to enable the actuating means 24 to apply a pressing force of substantial magnitude while keeping the support structure 21 free of loads caused by such actuating means 24. The actuating means 24 may be any suitable actuating means known in the art. However, as illustrated in FIGS. 3 and 4 such actuating means in this example as in the form of a fluid operated actuating means or a single air cylinder which is also designated by the reference numeral 24. The air cylinder 24 may be utilized to move the head assembly 23 both toward and away from the buck 22, or such air cylinder 24 may be utilized to move the head assembly 23 toward the buck 22 and mechanical springs used to move assembly 23 away from the buck as will be described subsequently.

Referring again to FIG. 6 of the drawings it will be seen that the guide means 25 of the press 20 comprises a plurality of fixed pivot means carried by the support structure and the plurality of fixed pivot means consists of pivot means or pivots 27 disposed in a lower horizontal plane 28 and fixed pivot means 30 disposed on an upper horizontal plane 29. As will be readily apparent from FIG. 6 the planes are spaced apart vertically along the support structure 21.

As also seen in FIG. 6 of the drawings the guide means 25 comprises a plurality of movable pivot means shown as movable pivot means 31 and 32 carried by the head assembly 23. The movable pivot means move between two positions shown in FIG. 6 by the solid line and dotted line positions of the head assembly 23.

The guide means 25 also comprises lever means pivotally connected between the fixed pivot means 27 and 30 and movable pivot means 31 and 32 respectively; and, such lever means comprises a plurality of levers each pivotally connected to an associated fixed pivot means on said support structure at one end thereof and pivotally connected to an associated movable pivot means on the head assembly 23 at its opposite end.

In particular, the plurality of levers comprises a pair of bottom levers, as best shown in FIG. 3, and each of said bottom levers is designated generally by the same reference numeral 33. Each of the bottom levers 33 is pivotally connected between an associated fixed pivot means 27 in the previously mentioned lower horizontal plane 28 along the support structure 21 in which the pivot means 27 are disposed and, as also seen in FIG. 6, an associated movable pivot means 31 disposed at the lower end portion 34 of a substantially vertical arm 35 of the head assembly 23, which in this example is a substantially C-shaped assembly.

The previously mentioned plurality of levers of the lever means pivotally connected between the fixed pivot means and movable pivot means previously described also comprises an upper lever 36 (FIG. 6) pivotally connected between the fixed pivot means 30 in the upper horizontal plane 29 along the support structure 21 and the movable pivot means 32 which in this example is disposed roughly midway along the vertical arm portion 35 of the C-shaped head assembly 23.

Figure 2:
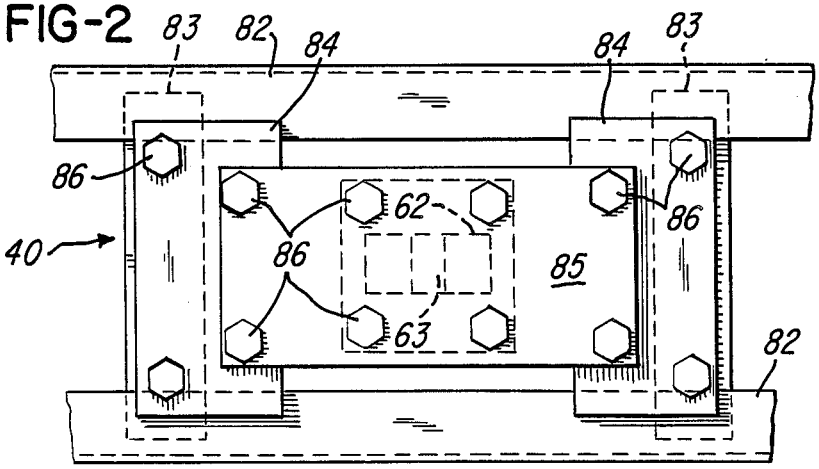
FIG. 2 is a fragmentary plan view particularly illustrating a mounting assembly which serves the dual purpose of carrying the buck and supporting the air cylinder in suspended relation.

Referring now to FIGS. 2 and 6 of the drawings it will be seen that the press 20 comprises a mounting assembly which is designated generally by the reference numeral 40 and such mounting assembly is carried by the support structure 21 and is suitably fastened thereto in any suitable manner known in the art. The mounting assembly 40 is carried by the support structure in a substantially horizontal plane 41 which is disposed vertically above the upper horizontal plane 29. The mounting assembly 40 also comprises anvil means designated generally by the reference numeral 42 which carries the buck 22 fastened thereon; and, such anvil means 42 may be suitably fixed to or defined as a part of assembly 40. Any suitable means known in the art may be provided for fastening the buck 22 to an upper portion of the anvil means 42.

In accordance with the further teachings of this invention the press 20 has means pivotally suspending the air cylinder 24 from a lower portion of the mounting assembly 40 and such means pivotally suspending is designated generally by the reference numeral 44 in FIG. 4 of the drawings. Thus, inasmuch as the mounting assembly 40 includes the anvil means 42 it will be seen that the anvil means, in essence, carries the weight of the buck 22, pressing forces applied against the buck by the head assembly 23 through the action of the air cylinder 24, and the weight of the air cylinder 24 itself and of the components associated with such air cylinder.

As previously mentioned, the head assembly 23 is a substantially C-shaped head assembly and in this example of the invention such C-shaped head assembly is comprised of a pair of substantially identical C-shaped plates each designated by the same reference numeral 46 in FIG. 3 of the drawings. The plates 46 are disposed vertically and in horizontally spaced apart relation. The plates 46 are held together as a unitary assembly by a suitable structural assembly 47 at the lower end thereof, an intermediate structural assembly 50, and a top structural assembly 51. Each of the structural assemblies 47, 50, and 51 has suitable cooperating components which enable the plates 46 to be held and supported in position. The lower assembly 47, intermediate assembly 50, and upper assembly or top assembly 51 define means connecting the plates 46 in parallel relation. Each of the C-shaped plates 46 has a top horizontal arm portion 53 (FIG. 6) and the same reference numeral 53 is also used to designate the top horizontal arm portion of head assembly 23. Each plate 46 has an integral vertical arm portion 35 and the vertical arm of the entire head assembly 23 is also designated by the same reference numeral 35. Similarly, each plate 46 has a bottom horizontal arm portion 34 and the bottom or lower horizontal arm portion of the entire C-shaped head assembly 23 is also designated by the same reference numeral 34.

Figure 5:
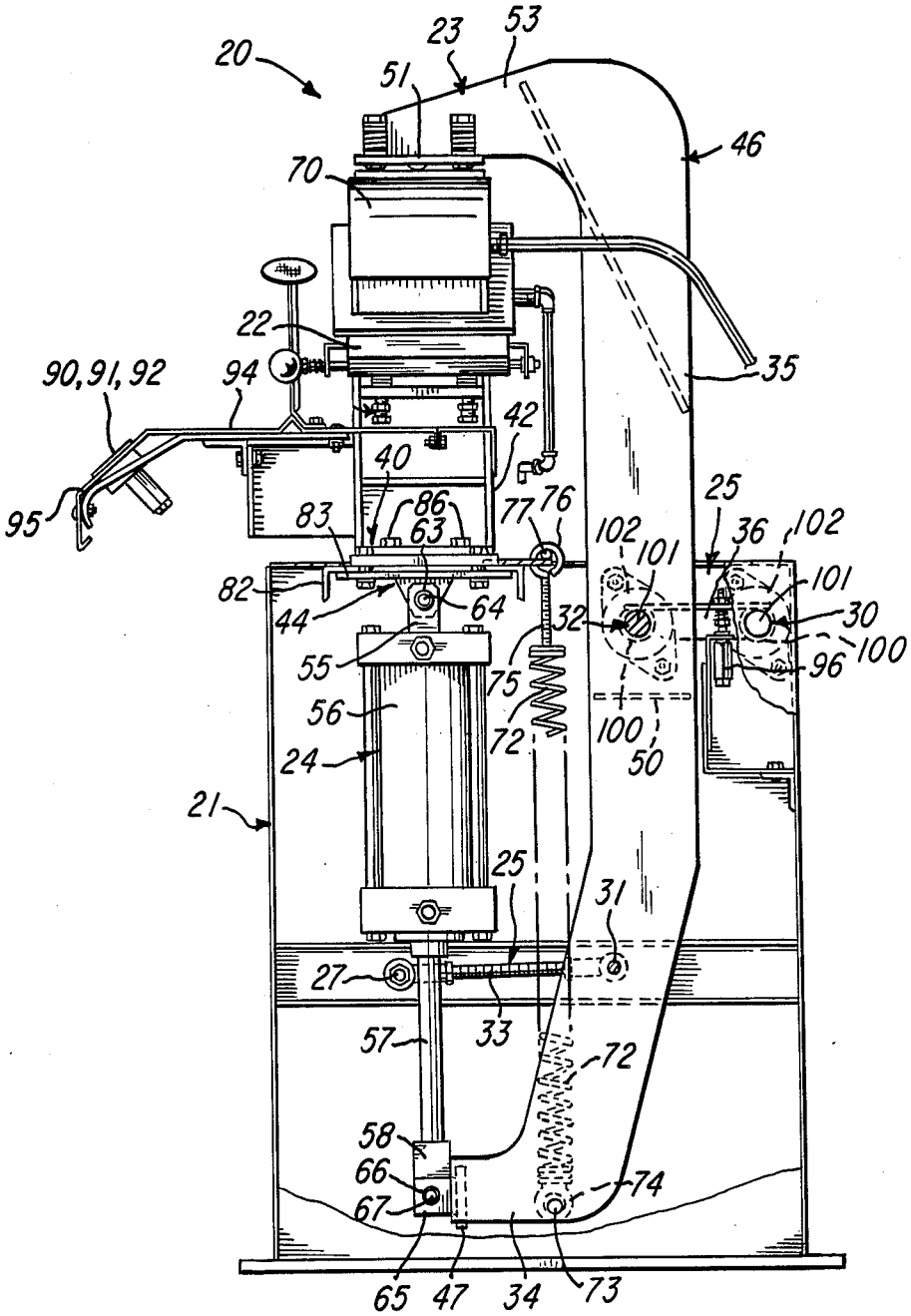
FIG. 5 is a view similar to FIG. 4 particularly illustrating the head assembly in its pressing position.

Referring now to FIGS. 4 and 5 of the drawings, it is seen that the air cylinder 24 has a first yoke 55 fixed to one end of a housing portion 56 thereof. The cylinder also has an extendible and retractable rod 57 extending from an opposite end of its housing portion 56. The rod 57 has an outer end portion 58 which is provided with a pin receiving opening 60 in its outer end, as shown in FIG. 3.

As previously mentioned the press 20 has means 44 pivotally suspending the air cylinder 24 from the mounting assembly 40 with its anvil means 42. The means 44 pivotally suspending comprises an upper lug 62 (FIG. 5) suitably fixed to the mounting assembly 40, a bore 63 which extends through lug 62 and yoke 55 of housing portion 46, and a first pin 64 (FIG. 4) extending through the bore 63.

As seen in FIG. 3, the C-shaped assembly 23 has a second yoke 65 fixed to the lower end portion 35 thereof and in particular to the structural assembly 47 comprising such lower end portion and the yoke 65 has a pin receiving opening 66 therein. The pin receiving opening 66 is adapted to be aligned with the pin receiving opening 60 in the outer end of the rod 57, i.e., portion 58 of such rod. A second pin or another pin 67 extends through the aligned pin receiving openings 66 and 60. In normal operation the air cylinder 24 operates to cause the head assembly 23 to exert its pressing force against the workpiece or shirt when the rod 57 is in its extended position and basically in vertical alignment between the pins 64 and 67. In this manner the maximum actuating force is applied in a vertical plane by the action of the air cylinder extending its rod 57 to, in essence, pull the head assembly 23 toward and against the buck which is supported by the anvil means and the same anvil means is supporting the weight of the air cylinder 24 and its components. The pressing force of the head assembly 23 is not transmitted to the frame assembly or support structure as will be discussed in more detail subsequently.

In this disclosure of the invention reference is made to the air cylinder 24 operating to urge the head assembly 23 toward the buck 22 and against a garment or shirt disposed thereon to apply pressing force thereagainst. However, it will be appreciated that the head assembly 23 has a pressing head portion 70 (FIGS. 1 and 3) and the reference to the head assembly being urged toward the buck and against the garment means that the head portion 70 of the head assembly is adapted to engage the garment or shirt and apply the pressing force thereagainst.

It was previously described in this specification that the top structural assembly 51 is provided for attaching the C-shaped plates 46 of the head assembly 23 together. The structural assembly 51 also serves to attach the pressing head portion 70 of the head assembly 23 in position. In particular, the assembly 51 serves to attach the pressing head 70 to the top horizontal arm portion 53 of the C-shaped plates 46 and hence top horizontal arm 53 of head assembly 23.

As previously described, the actuating means or air cylinder 24 may be used to move the head assembly 23 toward and away from the buck 22. It will also be seen in FIGS. 3 and 5 that the press 20 also comprises spring means shown as a pair of tension springs each designated by the same reference numeral 72. In the case of an air cylinder 24 used to move the head assembly both toward and away from the buck 22, the springs 72 act between the head assembly 23 and the support structure and move the head assembly 23 away from the buck 22 in the event the air cylinder becomes inoperative.

However, in a modification of this invention the springs 72 may be used as the sole means for moving the head assembly 23 away from the buck 22 and in this case the air cylinder 24 is used to override the springs 72 and move the head assembly 23 toward the buck 22 and apply the pressing force against the workpiece carried on such buck.

Each of the pair of springs 72 has its lower end suitably fastened to the lower end portion 34 of the C-shaped head assembly 23 utilizing a pin means or pin 73. Each pin 73 is fixed to end portion 34 and extends through a loop 74 in the end of the spring.

The upper end portion of each spring 72 has a rod extension 75 provided with a loop 76 therein; and a pin 77 extends through the loop 76 in the rod extension 75. The pin 77 engages an upper portion of the supporting structure 21 so as to fasten the upper end portion of each spring in position on the support structure 21.

In the modification of this invention where the air cylinder 24 is used to move the rod 57 to its extended and retracted positions, when the air cylinder 24 is operated to extend the rod 57 thereof, the springs 72 are extended and placed in further tension. When the cylinder is operated to retract the rod 57 thereof, the extended tension springs 72 merely contract due to the action thereof; but, they are still in tension. However, in the event of loss of air pressure to the air cylinder 24 the tension springs 72 operate to move the assembly so that the pressing head 70 thereof is moved away from the buck and to the retracted position illustrated at 79 in FIG. 4.

The press 20 may be in the form of a dry cleaning press, or in the form of a laundry press. Further, the buck and pressing head portions of such a press may be suitably modified to accommodate the workpiece or particular article to be pressed thereon. The press illustrated in this example of the invention is in the form of a collar and cuff press for shirts whereby the head 70 thereof has been modified and has a suitable pressing surface designated generally by the reference numeral 80 which is adapted to press the collar and a pair of cuffs of a shirt in a simultaneous manner. It will also be appreciated that the buck 22 may be provided with suitable padding 81 and be constructed to mate with pressing head 80 to provide an efficient pressing of a centrally disposed collar and cuffs on opposite sides of such collar in a simultaneous manner.

The press 20 may be provided with suitable controls including adjustable timers, air pressure regulators, and the like. The double-acting air cylinder 24 is suitably provided with suitable means including pressure lines, regulators, etc., to enable application of air pressure to opposite sides thereof so as to extend and retract rod 57.

In the modification of this invention where the springs 72 are used to retract the head assembly 23 away from the buck 22 and the air cylinder 24 is used to extend rod 57 and move such head assembly 23 so that it exerts a pressing force against the buck 22, the air cylinder 24 is similarly provided with suitable operating means. In particularly, the air cylinder 24 is provided with suitable pressure lines, regulators, etc., to enable the application of air pressure to only one side thereof to extend the rod 57. In this instance, the rod 57 is retracted by the springs 72 thereby allowing greater simplicity and economy in the pneumatic components of the press.

The various controls, timers, air pressure regulators, air lines, electrical connections, support brackets, and related components are all standard items which are well known in the art for both modifications of the press of this invention. Accordingly, these standard items and their use will not be described further.

As previously mentioned the mounting assembly 40 is disposed in the plane 41 and such mounting assembly has components which enable self-aligning thereof so that the upper lug 62 (FIG. 6) and the yoke 55 of the air cylinder 24 may be moved in the horizontal plane 41 to an optimum position. The mounting assembly comprises a pair of members 82 of L-shaped cross section (FIGS. 2 and 6) suitably fastened to the support structure 21, a pair of clamping plates each designated by the same reference numeral 83, a pair of substantially U-shaped base members 84 defining the base of the anvil means of the buck 22, and a bracket plate 85. These components of the mounting assembly are suitably fastened together by threaded bolts, each designated by the same reference numeral 86, and associated nuts 87.

The press 20 may be provided with the usual sources of electrical power; pneumatic or other fluid power; and electrical, pneumatic, and other operating means known in the art. Because such components and operating means with any required controls are well known in the art they have not been shown and thus will not be described.

Referring again to FIG. 1 of the drawings it is seen that the press 20 has a pair of buttons each designated by the same reference numeral 90, either one of which could be actuated to open the head assembly 23 whereby such head assembly moves to the position shown in FIG. 1. The press 20 also has a pair of head closing buttons designated by the reference numerals 91 and 92. The control system of the press is such that the head assembly 23 cannot be closed (i.e., the head portion 7 of assembly 23 cannot be moved into pressing engagement with the buck 22) except by pressing both buttons 91 and 92 simultaneously. It will be noted that the buttons 91 and 92 are spaced apart such that an operator of the press 20 must use both hands to push both buttons 91 and 92 simultaneously; and, this feature, which is known in the art, serves as a safety feature which assures that the pressing head 70 will not be operated against the operator's hands. The buttons 90, 91, and 92 are suitably mounted for easy access on a panel 94 and toward this objective the panel has a depending skirt portion 95 on which the buttons 90, 91, and 92 are mounted.

Referring now to FIG. 5 of the drawings, it is seen that the press 20 also employs a safety air switch 96 as is known in the art. The switch is suitably mounted on the supporting structure 21 and is provided with the usual contacts and associated controls (not shown) of the standard or known control system. The controls of switch 96 are operatively connected with the overall control system of the press 20 which include the control components of the air cylinder 24. The switch 96 serves as a safety switch that assures the head assembly 23 will open immediately if the press operator lifts his or her hands off the closing buttons 91-92 before the pressing head 70 is within one half inch of contacting the padding on the buck 22.

Referring now to FIG. 4 of the drawings, it is seen that the upper lever 36 comprising the guide means 25 is comprised essentially of a flat plate 97 which is suitably fixed as by welding to tubular bearing components each designated by the same reference numeral 100 at opposite ends thereof. Each tubular bearing component 100 has a bearing pin 101 extending therethrough which is mounted in an associated bearing 102 carried by either the structure 21 or the head assembly 23. Each bearing assembly 102 is suitably mounted on either structure 21 or head assembly 23, as the case may be, utilizing any suitable fastening means or mounting means known in the art.

It will also be appreciated that instead of providing an air cylinder 24 any other hydraulic, electrical, mechanical, or other pneumatic means may be provided as actuating means for the press. A fluid or pneumatic means known as an air bag has particular promise for use in a garment press. In using such an air bag, the means for installing and attaching same on the press 20 would be as is known in the art.

As described earlier the guide means 25 of press 20 comprises certain levers 33 and 36 which are disposed in the lower horizontal plane 28 and the upper horizontal plane 29 respectively. The levers move such that with the head assembly 23 in its pressing position such levers are moved to horizontal positions in plane approximately parallel with the horizontal planes 28 and 29.

It should be emphasized that with the press 20 of this invention forces applied by the air cylinder 24 operate to exert the head assembly 23 against the buck 22 and the forces are not transmitted through the support structure 21. Indeed, when the head assembly 23 is in its pressing position the guide means and indeed the levers 33 and 36 comprising such guide means serve no significant function inasumch as there is no load transmitted through them. To highlight this point it would be possible to disconnect the levers 33 and 36 from the structure with the head assembly in its pressing position and the air cylinder 24 would still apply its pressing force and the construction of components would be such that the head assembly would stay in line and a force would be applied by the head assembly to the workpiece supported on the buck.

In this example of the invention the garment press 20 has been illustrated as a garment press in the form of a laundry press for the collar and cuffs of a shirt; however, it is to be understood that the concept of this invention may be utilized on any suitable laundry press or any suitable dry cleaning press. Indeed, and as mentioned earlier, the concept of this invention may be utilized on presses for other applications other than presses for pressing garments.

In this disclosure of the invention words such as upper, lower, and the like have been used for convenience and ease of description and presentation. However, it is to be understood that these terms are not to be considered limiting in any way.

Thus, it is seen from the foregoing specification that this invention provides a new press and method of making the same which are superior to previous presses and methods of making the same; and, such press and method of making are superior because, among other items, it is possible to provide an optimum pressing function utilizing a minimum amount of structural material and thereby, in essence, providing a very lightweight and economical press structure.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the words "the improvement" and sets forth what is believed to be new in each claim according to this invention in the portion of each claim that is disposed after the words "the improvement" whereby it is believed that each claim sets forth novel, useful, and unobvious invention within the purview of the Patent Statut

What is claimed is:

1. In a press having a support structure, a first member carried by said support structure and being adapted to support a workpiece, a second member carried by said support structure, and actuating means for urging said second member toward said first member and against said workpiece to apply a pressing force thereagainst, the improvement comprising, guide means operatively connected between said second member and said support structure for guiding said second member toward and away from said first member, said actuating means and guide means being arranged for cooperation to enable said actuating means to apply said pressing force while keeping said guide means and support structure free of loads caused by said actuating means, and wherein said guide means is arranged to be moved solely by movement of said second member.

2. A press as set forth in claim 1 in which said actuating means consists of a single fluid power operated means which is adapted to move said second member toward said first member and further comprising mechanical spring means which is adapted to move said second member away from said first member.

3. A press as set forth in claim 1 in which said actuating means consists of a single fluid power operated means which is adapted to move said second member both toward away from said first member.

4. In a press having a support structure, a first member carried by said support structure and being adapted to support a workpiece, a second member carried by said support structure, and actuating means for urging said second member toward said first member and against said workpiece to apply a pressing force thereagainst, the improvement comprising; guide means operatively connected between said second member and said support structure for guiding said second member toward and away from said first member; said actuating means and guide means being arranged for cooperation to enable said actuating means to apply said pressing force while keeping said support structure free of loads caused by said actuating means; said guide means comprising a plurality of fixed pivot means carried by said second member, and lever means pivotally connected between said fixed pivot means and movable pivot means, and wherein said lever means is arranged to be moved solely by movement of said second member.

5. A press as set forth in claim 4 in which said lever means comprises a plurality of levers each pivotally connected to an associated fixed pivot means on said support structure at one end thereof and pivotally connected to an associated movable pivot means on said second member at its opposite end.

6. A press as set forth in claim 5 in which said plurality of fixed pivot means are disposed in an upper and a lower horizontal plane and said planes are spaced apart vertically along said support structure.

7. A press as set forth in claim 6 in which said actuating means consists of a single air cylinder and further comprising a mounting assembly carried by said support structure to a substantially horizontal plane disposed vertically above said upper horizontal plane, means detachably fastening said first member to an upper portion of said mounting assembly, and means pivotally suspending said air cylinder from a lower portion of said mounting assembly.

8. A press as set forth in claim 6 in which said single air cylinder has a first yoke fixed to one end of a housing portion thereof and has an extendible and retractable rod extending from an opposite end of its housing portion, with said rod having a pin-receiving opening in its outer end; said means pivotally suspending said air cylinder comprises an upper lug fixed to said mounting assembly, a bore extending through said lug and first yoke, and a first pin extending through said bore; said second member is a substantially C-shaped assembly and comprises a second yoke fixed to a lower end portion thereof, said second yoke having a pin-receiving opening therein adapted to be aligned with said pin-receiving opening in the outer end of said rod; and a second pin extending through said pin-receiving openings; said air cylinder operating to cause said head assembly to exert its pressing force against said workpiece when said rod is in its extended position and in vertical alignment between said first and second pins.

9. A press as set forth in claim 6 in which said second member is a substantially C-shaped assembly which comprises a pair of substantially identical C-shaped plates disposed in vertically spaced apart relation; each of said C-shaped plates having a top horizontal arm portion, a bottom horizontal arm portion, and an integral vertical arm portion disposed therebetween; and means connecting said plates in parallel relation.

10. A press as set forth in claim 6 in which said second member is a substantially C-shaped assembly and said plurality of levers comprises an upper lever pivotally connected between a fixed pivot means in said upper horizontal plane along said support structure and a movable pivot means disposed roughly midway along a vertical arm portion of said C-shaped assembly.

11. A press as set forth in claim 10 in which said plurality of levers comprises a pair of bottom levers each pivotally connected between an associated fixed pivot means in said lower horizontal plane along said support structure and an associated movable pivot means disposed at the lower end portion of said vertical arm portion of said C-shaped assembly.

12. In a garment press having a support structure, a buck carried by said support structure and being adapted to support a garment to be pressed, a head assembly carried by said support structure, and actuating means for urging said head assembly toward said buck and against said garment to apply a pressing force thereagainst, the improvement comprising, guide means operatively connected between said head assembly and said support structure for guiding said head assembly toward and away from said buck, said actuating means and guide means being arranged for cooperation to enable said actuating means to apply said pressing force while keeping said guide means and support structure free of loads caused by said actuating means, and wherein said lever means is arranged to be moved solely by movement of said second member.

13. A press as set forth in claim 12 in which said actuating means consists of a single fluid power operated means which is adapted to move said head assembly toward said buck and further comprising mechanical spring means which is adapted to move said head assembly away from said buck.

14. A press as set forth in claim 12 in which said actuating means consists of a single fluid power operated means which is adapted to move said head assembly both toward and away from said buck.

15. In a garment press having a support structure, a buck carried by said support structure and being adapted to support a garment to be pressed, a head assembly carried by said support structure, and actuating means for urging said head assembly toward said buck and against said garment to apply a pressing force thereagainst, the improvement comprising; guide means operatively connected between said head assembly and said support structure for guiding said head assembly toward and away from said buck; said actuating means and guide means cooperating to enable said actuating means to apply said pressing force while keeping said support structure free of loads caused by said actuating means; said guide means comprising a plurality of fixed pivot means carried by said support structure, a plurality of movable pivot means carried by said head assembly, and lever means pivotally connected between said fixed pivot means and movable pivot means, and wherein said lever means is arranged to be moved solely by movement of said head assembly.

16. A press as set forth in claim 15 in which said lever means comprises a plurality of levers each pivotally connected to an associated fixed pivot means on said support structure at one end thereof and pivotally connected to an associated movable pivot means on said head assembly at its opposite end.

17. A press as set forth in claim 16 in which said plurality of fixed pivot means are disposed in an upper and a lower horizontal plane and said planes are spaced apart vertically along said support structure.

18. A press as set forth in claim 17 in which said actuating means consists of a single air cylinder and further comprising a mounting assembly carried by said support structure in a substantially horizontal plane disposed vertically above said upper horizontal plane; said mounting assembly comprising anvil means which carries said buck; means fastening said buck to an upper portion of said anvil means; and means pivotally suspending said air cylinder from a lower portion of said mounting assembly which includes said anvil means whereby said anvil means, in essence, carries the weight of said buck, pressing forces applied against said buck by said head assembly through the action of said air cylinder, and the weight of said air cylinder itself.

19. A press as set forth in claim 17 in which said actuating means consists of a single air cylinder, said single air cylinder has a first yoke fixed to one end of a housing portion thereof and has an extendible and retractable rod extending from an opposite end of its housing portion with said rod having a pin-receiving opening in its outer end; said means pivotally suspending said air cylinder comprises an upper lug fixed to said mounting assembly, a bore extending through said lug and first yoke, and a first pin extending through said bore; said head assembly is a substantially C-shaped assembly and comprises a second yoke fixed to a lower end portion thereof, said second yoke having a pin-receiving opening therein adapted to be aligned with said pin-receiving opening in the outer end of said rod; and a second pin extending through said pin-receiving openings; said air cylinder operating to cause a pressing head of said head assembly to exert its pressing force against said garment when said rod is in its extended position and in vertical alignment between said first and second pins.

20. A press as set forth in claim 17 in which said head assembly is a substantially C-shaped assembly which comprises a pair of substantially identical C-shaped plates disposed in vertically spaced apart relation; each of said C-shaped plates having a top horizontal arm portion, a bottom horizontal arm portion, and an integral vertical arm portion disposed therebetween; means connecting said plates in parallel relation; a pressing head for said head assembly which is adapted to engage said garment and apply said pressing force thereagainst; and means attaching said pressing head to said top horizontal arm portions of said C-shaped plates.

21. A press as set forth in claim 17 in which said head assembly is a substantially C-shaped assembly and said plurality of levers comprises an upper lever pivotally connected between a fixed pivot means in said upper horizontal plane along said support structure and a movable pivot means disposed roughly midway along a vertical arm portion of said C-shaped assembly.

22. A press as set forth in claim 21 in which said plurality of levers comprises a pair of bottom levers each pivotally connected between an associated fixed pivot means in said lower horizontal plane along with support structure and an associated movable pivot means disposed at the lower end portion of said vertical arm portion of said C-shaped assembly.

23. A press as set forth in claim 12 in the form of a dry cleaning press.

24. A press as set forth in claim 12 in the form of a laundry press.

25. A press as set forth in claim 14 and further comprising spring means acting between said head assembly and said support structure for moving said head assembly away from said buck in the event said air cylinder becomes inoperative.

26. A press as set forth in claim 1 in which said guide means comprises a plurality of fixed pivot means carried by said support structure, a plurality of movable pivot means carried by said second member, and lever means pivotally connected between said fixed pivot means and movable pivot means.

27. A press as set forth in claim 26 in which said lever means comprises a plurality of levers each pivotally connected to an associated fixed pivot means on said support structure at one end thereof and pivotally connected to an associated movable pivot means on said second member at its opposite end, said levers being pivoted about said fixed pivot means with said movement of said second member.

28. A press as set forth in claim 12, in which said guide means comprises a plurality of fixed pivot means carried by said support structure, a plurality of movable pivot means carried by said head assembly, and lever means pivotally connected between said fixed pivot means and movable pivot means.

29. A press as set forth in claim 28 in which said lever means comprises a plurality of levers each pivotally connected to an associated fixed pivot means on said support structure at one end thereof and pivotally connected to an associated movable pivot means on said head assembly at its opposite end, said levers being pivoted about said fixed pivot means with said movement of said head assembly.

* * * * *

UNITED STATES PATENT AND TRADEMARK OFFICE

CERTIFICATE OF CORRECTION

PATENT NO. : 4,843,745

DATED : July 4, 1989

INVENTOR(S) : Gene L. OBERLEY

It is certified that error appears in the above-identified patent and that said Letters Patent is hereby corrected as shown below:

In column 5, line 47, change "5" to —6—.

In column 5, line 49, change "46" to —56—.

In column 10, line 4, insert —and— after "toward".

Signed and Sealed this

First Day of January, 1991

*Attest:*

HARRY F. MANBECK, JR.

*Attesting Officer*

*Commissioner of Patents and Trademarks*